US010578383B2

(12) United States Patent
Murphy, II et al.

(10) Patent No.: US 10,578,383 B2
(45) Date of Patent: Mar. 3, 2020

(54) FIREARM GRIP WITH INTEGRATED LOCKING MECHANISM

(71) Applicants: William Lewis Murphy, II, Orlando, FL (US); Robert Vail Harvey, Orlando, FL (US)

(72) Inventors: William Lewis Murphy, II, Orlando, FL (US); Robert Vail Harvey, Orlando, FL (US)

(73) Assignee: Gun Guardian LLC, Orlando, FL (US)

( * ) Notice: Subject to any disclaimer, the term of this patent is extended or adjusted under 35 U.S.C. 154(b) by 0 days.

(21) Appl. No.: 16/415,709

(22) Filed: May 17, 2019

(65) Prior Publication Data

US 2019/0301823 A1 Oct. 3, 2019

Related U.S. Application Data

(63) Continuation-in-part of application No. 16/229,007, filed on Dec. 21, 2018, now Pat. No. 10,378,846, and a continuation-in-part of application No. 16/156,960, filed on Oct. 10, 2018, and a continuation-in-part of application No. 16/390,520, filed on Apr. 22, 2019, which is a continuation of application No. (Continued)

(51) Int. Cl.

| | |
|---|---|
| ***F41A 17/06*** | (2006.01) |
| ***F41A 17/20*** | (2006.01) |
| ***F41C 23/16*** | (2006.01) |
| ***F41C 23/10*** | (2006.01) |

(52) U.S. Cl.

CPC ..... *F41A 17/20* (2013.01); *F41A 17/063* (2013.01); *F41A 17/066* (2013.01); *F41C 23/10* (2013.01); *F41C 23/16* (2013.01)

(58) Field of Classification Search

CPC ..... F41A 17/20; F41A 17/066; F41A 17/063; F41C 23/16; F41C 23/10; F41C 23/22; F41C 23/04

USPC ..... 42/71.01–74

See application file for complete search history.

(56) References Cited

U.S. PATENT DOCUMENTS

| | | | |
|---|---|---|---|
| 35,456 A | 6/1862 | Leverich | |
| 955,237 A | 4/1910 | Westcott et al. | |

(Continued)

FOREIGN PATENT DOCUMENTS

| | | | |
|---|---|---|---|
| DE | 102006005117 A1 | 8/2007 | |
| DE | 102006022795 A1 * | 12/2007 | ..... F41C 23/22 |
| EP | 1058081 B1 | 1/2006 | |

*Primary Examiner* — Jonathan C Weber

(74) *Attorney, Agent, or Firm* — Jason T. Daniel, Esq.; Daniel Law Offices, P.A.

(57) ABSTRACT

A firearm grip with locking mechanism includes an elongated handgrip body having an elongated opening on the front side and a generally hollow interior space. A pair of doors are pivotally secured to the handgrip body to move between a closed position, and an open position. A firearm engagement body is pivotally secured along the top end of the handgrip body for attachment to a firearm receiver at a location adjacent to the trigger assembly. The handgrip body moves between a FIRE position where the handgrip body is positioned perpendicular to the engagement body, and a SAFE position where the handgrip body is positioned parallel to the engagement body and the firearm trigger assembly is located within the interior space of the handgrip body.

20 Claims, 11 Drawing Sheets

Related U.S. Application Data

15/484,795, filed on Apr. 11, 2017, now Pat. No. 10,267,583, which is a continuation-in-part of application No. 15/261,279, filed on Sep. 9, 2016, now Pat. No. 9,784,516, said application No. 16/229,007 is a continuation-in-part of application No. 15/040,966, filed on Feb. 12, 2016, now abandoned, which is a continuation-in-part of application No. 14/885,394, filed on Oct. 16, 2015, now abandoned, said application No. 15/261,279 is a continuation-in-part of application No. 14/885,394, filed on Oct. 16, 2015, now abandoned, said application No. 15/040,966 is a continuation-in-part of application No. 13/732,583, filed on Jan. 2, 2013, now Pat. No. 9,810,500, said application No. 16/229,007 is a continuation-in-part of application No. 13/732,583, filed on Jan. 2, 2013, now Pat. No. 9,810,500.

(60) Provisional application No. 62/673,434, filed on May 18, 2018, provisional application No. 62/570,245, filed on Oct. 10, 2017, provisional application No. 62/322,339, filed on Apr. 14, 2016.

(56) References Cited

U.S. PATENT DOCUMENTS

| | | | | | |
|---|---|---|---|---|---|
| 1,569,553 | A | | 1/1926 | Lewis et al. | |
| 1,686,482 | A | | 10/1928 | Windle | |
| 1,695,071 | A | | 12/1928 | Mariand | |
| 1,887,308 | A | | 11/1932 | Leroy | |
| 2,080,202 | A | | 5/1937 | Drake | |
| 2,115,041 | A | | 4/1938 | Alejandro | |
| 2,495,977 | A | * | 1/1950 | Madsen | F41C 23/22 42/71.01 |
| 2,590,516 | A | | 3/1952 | Von | |
| 2,932,334 | A | | 4/1960 | Steen | |
| 3,222,809 | A | | 12/1965 | Bryan | |
| 3,224,587 | A | | 12/1965 | Schmidt | |
| 3,369,316 | A | * | 2/1968 | Miller | F41C 23/04 42/72 |
| 3,392,471 | A | | 7/1968 | Foote | |
| 3,619,930 | A | * | 11/1971 | Beermann | F41C 3/02 42/69.01 |
| 3,979,850 | A | * | 9/1976 | Schiessl | F41A 11/04 42/71.02 |
| 4,422,254 | A | | 12/1983 | McQueen | |
| 4,754,498 | A | | 7/1988 | Stinemates | |
| 4,858,361 | A | | 8/1989 | White | |
| 4,860,479 | A | | 8/1989 | Easter | |
| 5,012,605 | A | | 5/1991 | Nishioka | |
| 5,024,017 | A | | 6/1991 | Nishioka | |
| 5,075,994 | A | | 12/1991 | Nishioka | |
| 5,138,786 | A | | 8/1992 | Fischer | |
| 5,229,532 | A | | 7/1993 | Brooks | |
| 5,419,068 | A | | 5/1995 | Pages et al. | |
| 5,638,627 | A | | 6/1997 | Klein et al. | |
| 5,924,233 | A | * | 7/1999 | Strobel | F41C 23/12 42/72 |
| 5,992,075 | A | | 11/1999 | Ockenfuss et al. | |
| 6,141,896 | A | | 11/2000 | Oberst | |
| 6,154,995 | A | | 12/2000 | Lenoir et al. | |
| 6,164,004 | A | | 12/2000 | Essary | |
| 6,206,261 | B1 | | 3/2001 | McCrary | |
| 6,240,669 | B1 | | 6/2001 | Spaniel et al. | |
| 6,253,480 | B1 | | 7/2001 | Florez | |
| 6,389,726 | B1 | | 5/2002 | Bentley | |
| 6,405,861 | B1 | | 6/2002 | Siler et al. | |
| 6,459,064 | B1 | | 10/2002 | Trubert | |
| 6,578,307 | B2 | | 6/2003 | Troyer | |
| 7,030,729 | B2 | | 4/2006 | Albanesi et al. | |
| 7,194,836 | B1 | | 3/2007 | Urban | |
| 7,937,873 | B2 | * | 5/2011 | Keng | F41C 23/04 42/71.01 |
| 8,522,582 | B2 | | 9/2013 | Keightley | |
| 8,713,836 | B1 | | 5/2014 | Haq | |
| 8,807,007 | B2 | | 8/2014 | Alicea | |
| 8,904,694 | B1 | * | 12/2014 | Afuh, II | F41A 9/00 42/96 |
| 8,931,393 | B1 | | 1/2015 | Vincent et al. | |
| 9,097,479 | B1 | | 8/2015 | Barido et al. | |
| 9,121,655 | B1 | | 9/2015 | Murphy et al. | |
| 9,228,795 | B1 | * | 1/2016 | Kielsmeier | F41C 23/14 |
| 9,404,699 | B1 | | 8/2016 | Barido et al. | |
| 9,459,064 | B1 | | 10/2016 | Xu | |
| 9,658,017 | B2 | | 5/2017 | Alicea | |
| 9,733,033 | B1 | | 8/2017 | Barido et al. | |
| 9,746,266 | B1 | | 8/2017 | Barido et al. | |
| 9,841,250 | B1 | | 12/2017 | Mirza | |
| 2002/0116856 | A1 | | 8/2002 | Troyer | |
| 2007/0261284 | A1 | * | 11/2007 | Keng | F41C 23/04 42/73 |
| 2010/0154271 | A1 | | 6/2010 | Victor et al. | |
| 2011/0047849 | A1 | | 3/2011 | Brenner | |
| 2011/0154707 | A1 | * | 6/2011 | Noonan | B29C 41/04 42/1.06 |
| 2012/0137559 | A1 | | 6/2012 | Burns | |
| 2015/0204628 | A1 | | 7/2015 | Würkner | |
| 2016/0084601 | A1 | | 3/2016 | Alicea | |
| 2016/0178314 | A1 | * | 6/2016 | Kielsmeier | F41C 23/14 42/73 |
| 2017/0356712 | A1 | * | 12/2017 | Johnson | F41A 19/21 |
| 2018/0231348 | A1 | * | 8/2018 | Whelan | F41C 23/22 |

* cited by examiner

FIREARM GRIP WITH INTEGRATED LOCKING MECHANISM

CROSS-REFERENCE TO RELATED APPLICATIONS

This application claims the benefit of U.S. Application 62/673,434 filed, on May 18, 2018, and is a continuation in part to U.S. application Ser. No. 16/156,960, filed on Oct. 10, 2018, which claims the benefit of U.S. Application 62/570,245, filed on Oct. 10, 2017, the contents of each of which are incorporated herein by reference.

TECHNICAL FIELD

The present invention relates generally to firearm safety devices, and more particularly to a rotating firearm grip having an integrated safety mechanism.

BACKGROUND

The statements in this section merely provide background information related to the present disclosure and may not constitute prior art.

Firearms should always remain locked when they are not in use to prevent an accidental discharge and/or to prevent access by unauthorized persons. For this reason, there are no shortage of commercially available firearm locking mechanisms. The vast majority of these devices are individual, separate components such as trigger guards and/or trigger locks, for example that can be manually secured along or about the external portion of the firearm trigger to prevent access to the same.

Although better than nothing, these devices suffer from several practical drawbacks. For example, because these locking mechanisms are externally mounted, it is not uncommon for one or more pieces of the locking mechanism to become lost when it is removed from the weapon. Additionally, users often secure the lock onto the weapon incorrectly, thereby causing a situation where access to the firearm can be obtained by an unauthorized user. Finally, the time required to physically remove the external lock may be unacceptable in emergency situations where the user needs immediate access to the weapon.

For these reasons, many individuals forego using a physical locking mechanism and instead store the weapon with the integrated selector switch at SAFE. Although the selector switch does work well to prevent an inadvertent discharge of the firearm, it does nothing to prevent an unauthorized user from firing the weapon by transitioning the switch from SAFE to FIRE.

The present invention, directed to a firearm grip with an integrated locking mechanism, differs from the conventional art in a number of aspects. The manner by which will become more apparent in the description which follows, particularly when read in conjunction with the accompanying drawings.

SUMMARY OF THE INVENTION

The present invention is directed to a firearm grip with locking mechanism. One embodiment of the present invention can include an elongated handgrip body having an elongated opening on the front side and a generally hollow interior space. A pair of doors can be pivotally secured to the handgrip body to selectively close the elongated opening in the closed position and can be positioned within the hollow interior space in the open position.

In one embodiment, a firearm engagement body is pivotally secured along the top end of the handgrip body. The engagement body including a shape and size that is suitable for attachment to a firearm receiver at a location adjacent to the trigger assembly. The handgrip body can function to move between a FIRE position where the handgrip body is positioned perpendicular to the engagement body, and a SAFE position where the handgrip body is positioned parallel to the engagement body and the firearm trigger assembly is located within the interior space of the handgrip body.

In one embodiment, a locking mechanism selectively positions the handgrip body at either the SAFE position or the FIRE position. The locking mechanism can communicate with one or more of a push button, an authentication unit and a system controller.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
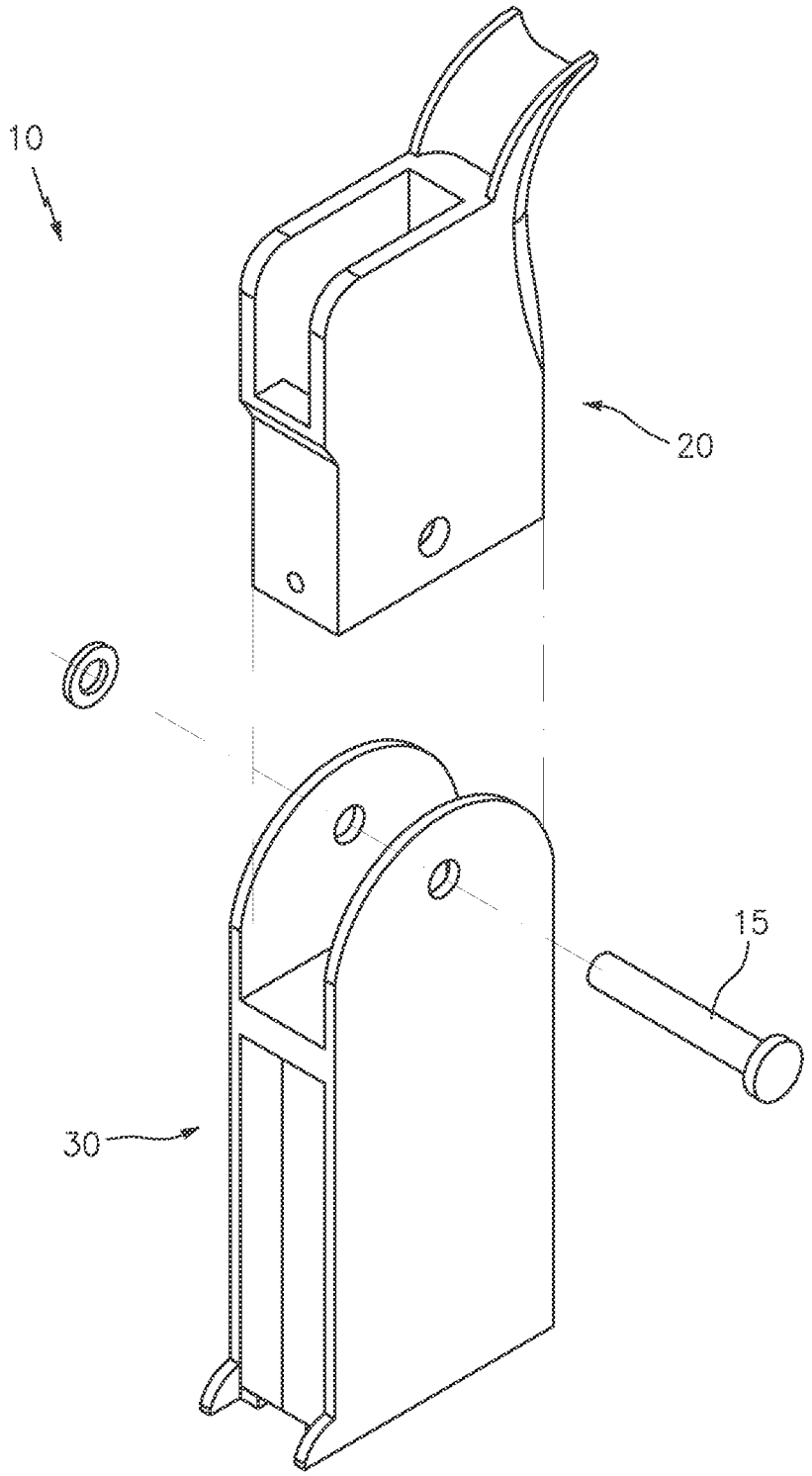
FIG. 1 is an exploded parts view of the firearm grip with integrated locking mechanism, in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

FIGS. 1-7 illustrate one embodiment of a firearm grip with integrated safety mechanism 10 (i.e., the device) that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 6.

As will be described below, the device 10 can function to replace the manufacturer-supplied handgrip of a firearm and can include dimensions and connectors at locations complementary to those found on the original handgrip, so as to use the manufacturer supplied hardware (e.g., springs, bolts, etc.). Conversely, the device can be incorporated into the design and construction of a new firearm so as to comprise a manufacturer supplied handgrip. In either instance, the grip is designed to be permanently secured to the receiver of a firearm so as to permanent incorporate a safety mechanism thereto.

As shown at FIG. 1, the device 10 can include, essentially, a firearm engagement member 20, that is pivotally secured to a handgrip 30 by a locking pin 15.

Figure 2:
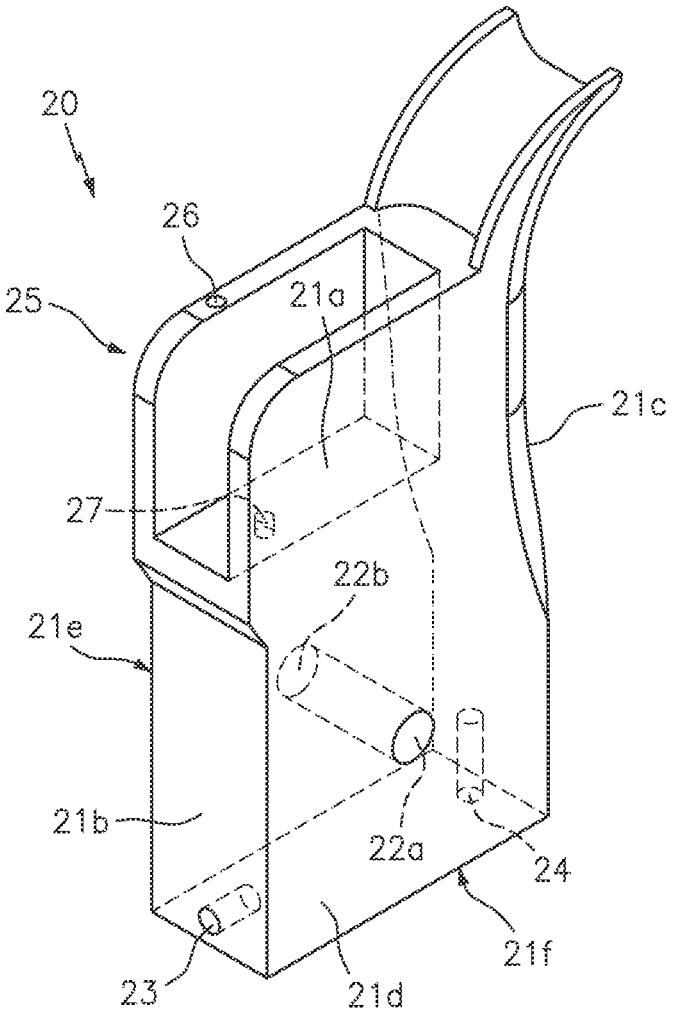
FIG. 2 is a perspective view of the firearm engagement member of the firearm grip with integrated locking mechanism, in accordance with one embodiment of the invention

FIG. 2 illustrates one embodiment of the firearm engagement member 20. As shown, the member can include a body section having a top end 21*a*, a front end 21*b*, a back end 21*c*, side walls 21*d*-21*e* and an open bottom end 21*f* that define a hollow interior space. A pair of large diameter openings 22*a* and 22*b* are positioned within the side walls 21*d* and 21*e*, respectively for receiving the locking pin 15.

In various embodiments, the front end 21*b* includes an aperture 23 for receiving the below described rod 41 when the device is in the locked/SAFE position. Likewise, a hollow cylindrical channel 24 can be positioned along the inside portion of the back end 21*c* to receive the rod 41 when the device is in the unlocked position.

An elongated channel 25 can extend upward from the top end of the body section. The channel functions to receive and engage the bottom end of a firearm receiver, so as to secure the device to a firearm at a location adjacent to the trigger assembly. To this end, the engagement member 20 can include any number of different apertures that are positioned along the channel and/or body section at locations complementary to those of the factory supplied handgrip, so as to use the same mounting hardware.

For example, when the grip 10 is designed for use with an AR-15 rifle, a first aperture 26 can be positioned along the top end of the channel 25 for receiving a spring, and a second aperture 27 can be positioned along the top end of the body section 21*a* between the walls of the channel 25, for receiving a bolt. Of course, any number of other apertures can be provided at any number of other locations for engaging the receiver of any type of firearm.

Figure 3A:
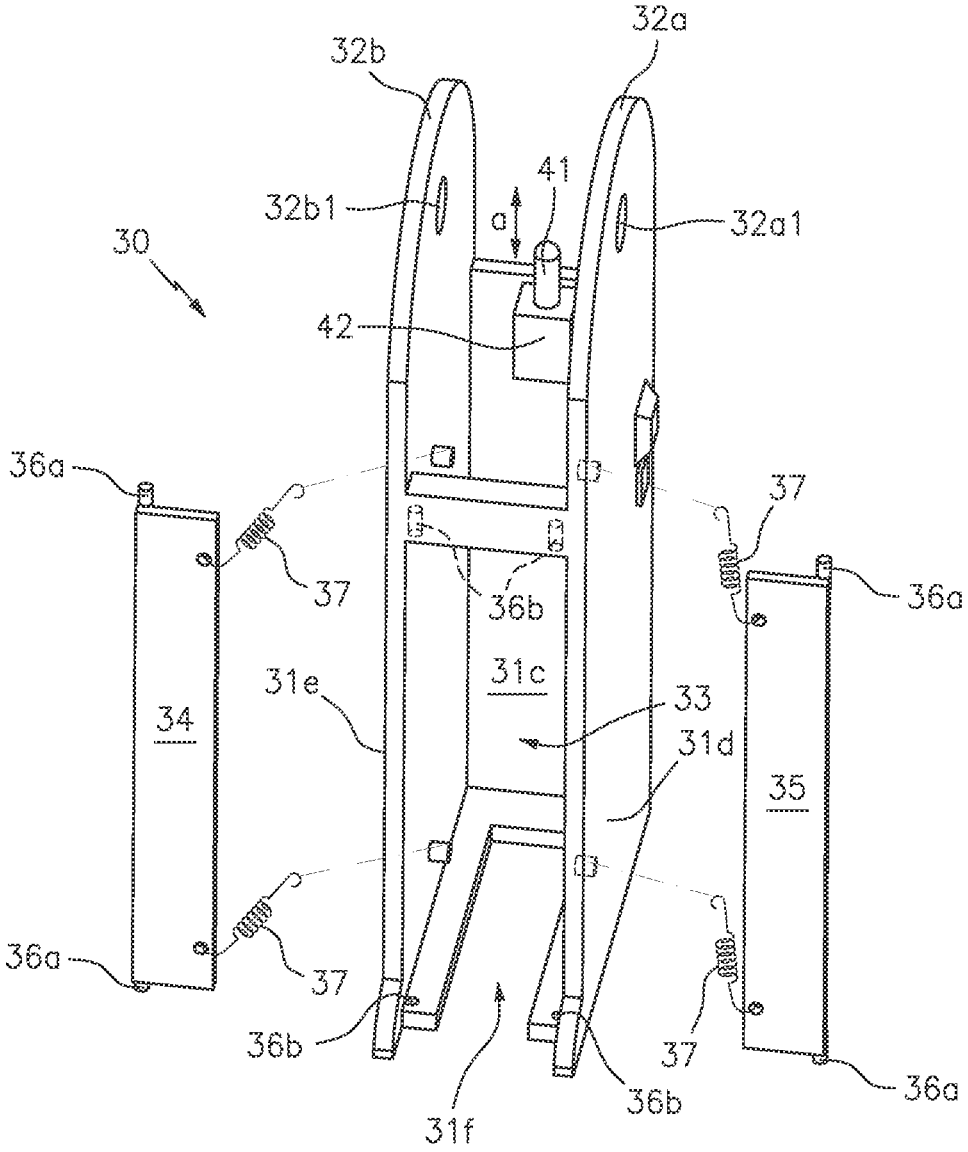
FIG. 3A is an exploded parts view of the handgrip body of the firearm grip with integrated locking mechanism, in accordance with one embodiment of the invention.
Figure 3B:
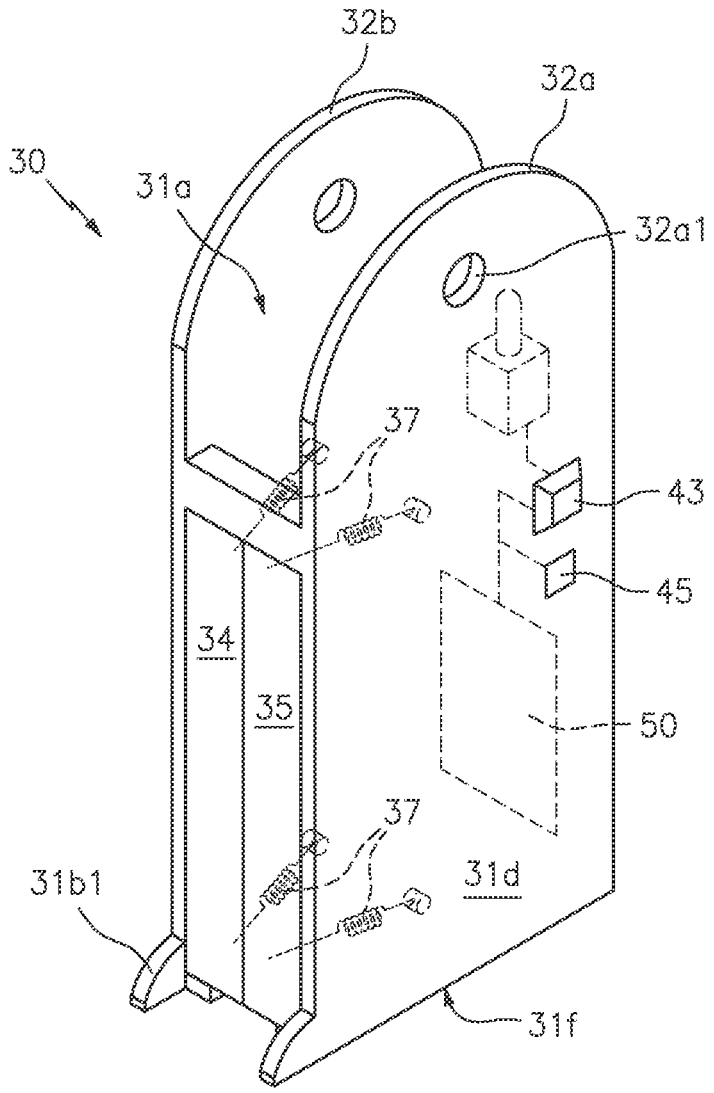
FIG. 3B is a perspective view of the firearm grip with integrated locking mechanism, in accordance with one embodiment of the invention.
Figure 3C:
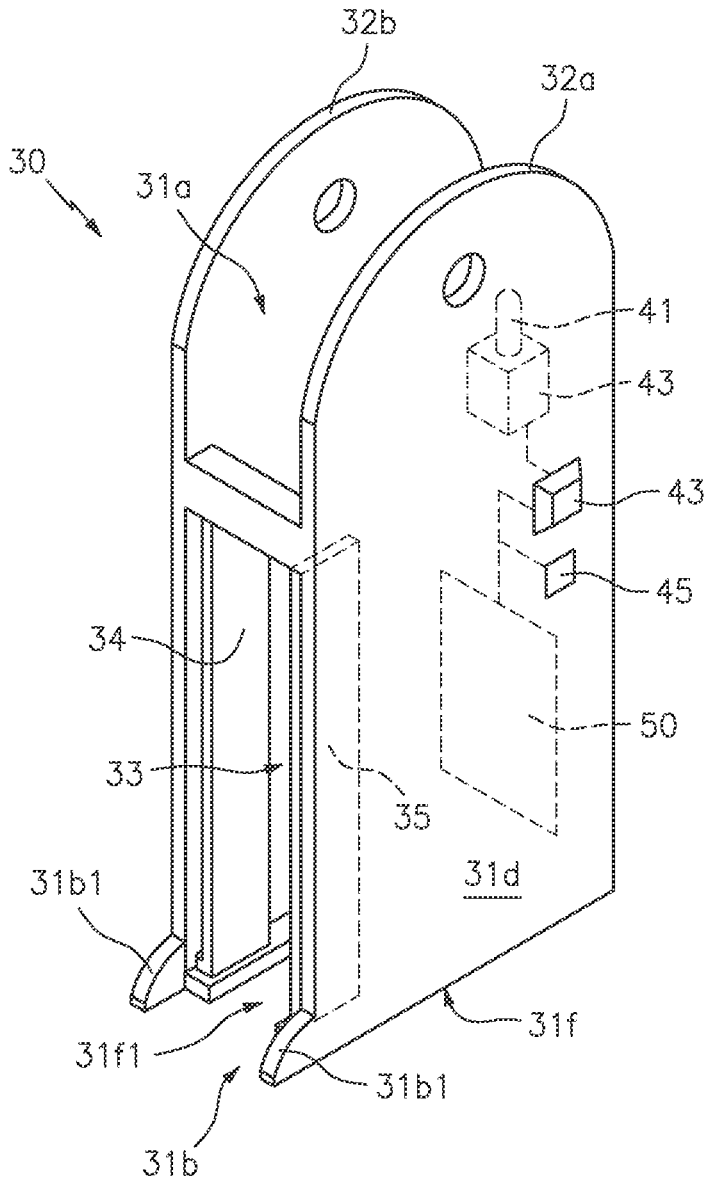
FIG. 3C is another perspective view of the of the firearm grip with integrated locking mechanism, in accordance with one embodiment of the invention.

FIGS. 3A-3C illustrate one embodiment of the handgrip 30. As shown, the grip can include an elongated body section having an open top end 31*a*, a front end 31*b*, a back end 31*c*, side walls 31*d*-31*e* and a bottom end 31*f* that define a hollow interior space. In the preferred embodiment, a generally U-shaped channel 31*f*1 can extend inward along the bottom of the handgrip body, and the front end can include protrusions 31*b*1 extending away from the front of the handgrip body. The exterior facing portions of the handgrip can include any number of gripping elements such as various finger ridges and/or rough texturing, to aid in a user's ability to grip the device and facilitate ease of use.

A channel having channel walls 32*a* and 32*b* can extend upward from the top end 31*a* of the body section. The bottom end of the engagement member 21*f* is smaller than the open top end of the grip 31*a* and is smaller than the dimension of the channel so as to be positioned between the channel walls and/or within the open top end 31*a*. When so positioned, the large diameter openings 32*a*1 and 32*b*1 of the channel are aligned with the openings 22*a* and 22*b* to receive the locking pin 15. In this manner, the handgrip 30 can rotate 90 degrees to transition between the FIRE position illustrated in FIG. 6 and the SAFE position illustrated in FIG. 7.

The front end of the of the receiver body 31*b* can include an elongated opening 33 into which a pair of generally planar doors 34 and 35 are positioned. In one embodiment, each of the doors can include protrusions 36*a* along one side that extend from the top and bottom ends. These can engage dimples/apertures 36*b* that are positioned along the edges of the opening 33 so as to allow the doors to pivot between the open position shown at FIG. 3C and the closed position shown at FIG. 3B. Although not specifically illustrated, ridges or other obstructions can be provided along the receiver body to prevent the doors from moving outward and away from the front end of the handgrip body 31*b*.

When the doors are in the closed position, the doors are positioned perpendicular to the side surfaces of the handgrip and function to completely cover the elongated opening 33. Of course, any number of other ways to secure the doors to the handgrip body are also contemplated. Any number of resilient tensioning members 37 such as springs, for example, can be connected between each door and the interior portion of the handgrip body. The tensioning members functioning to impart a constant pushing force on the doors (e.g., in a direction toward the front end 31*b*) to maintain the doors in the closed unless acted upon.

As described herein, the handgrip body and each of the doors can be constructed from any number of rigid durable materials such as plastic and/or various metals, for example. Moreover, the handgrip and doors can be constructed to include any number of different shapes and sizes, so as to be compatible with virtually any type of firearm.

Although described above as including a pair of doors, this is for illustrative purposes only. To this end, other embodiments are contemplated wherein a single door is provided that is secured along one side of the grip and functions to selectively open and close in the same manner described above.

A locking mechanism having a retractable rod 41 can be positioned along the inside top portion of the back end 31*c* of the handgrip body. The rod can be connected to an actuator 42 that extends and retracts the rod linearly as shown by arrow a.

In one embodiment, the actuator 42 can include a mechanical device having any number of tensioning mechanisms such as a spring, for example, that can be manipulated by a push button 43 to allow the rod to extend away from or retract within the top end of the handgrip body 31*a*. An authentication device 45 can include any number of mechanical or electromechanical devices capable of accepting a user input so as to allow operation of the actuator. When used with a purely mechanical actuator, the authentication device 45 can include a mechanical combination lock having a series of numbers or letters which must be entered in a proper sequence to allow the actuator to move. In this regard, the authentication device can be physically coupled to the actuator 42 or button 43, and can function to block movement of the actuator and rod unless the proper sequence has been entered. Combination locking systems and associated components are extremely well known in the art, and any number of such commercially available systems can be utilized herein.

In one embodiment, the actuator 42 can include or comprise an electromechanical device or assembly such as a linear actuator system, for example. In such an embodiment, the authentication device 45 can preferably include or control a biometric authentication system such as the illustrated fingerprint sensor, for example that is communicatively linked to a system controller 50.

As will be known to those of skill in the art, a biometric authentication system may record the fingerprint of the user and store the image of the fingerprint in the memory 52. As such, upon recognition of the users fingerprint applied to the sensor, the processor can instruct the electromechanical actuator to retract, thereby allowing the grip to transition from the SAFE position to the FIRE position. Of course, the authentication unit is not limited to the use of a biometric sensor, as any number of other known systems for receiving and/or verifying a user input are also contemplated. Several nonlimiting examples include the use of an electromechanical combination lock system and/or a wireless authentication system such as an RFID interrogator that can be used with an externally located RFID sensor, for example.

Figure 4A:
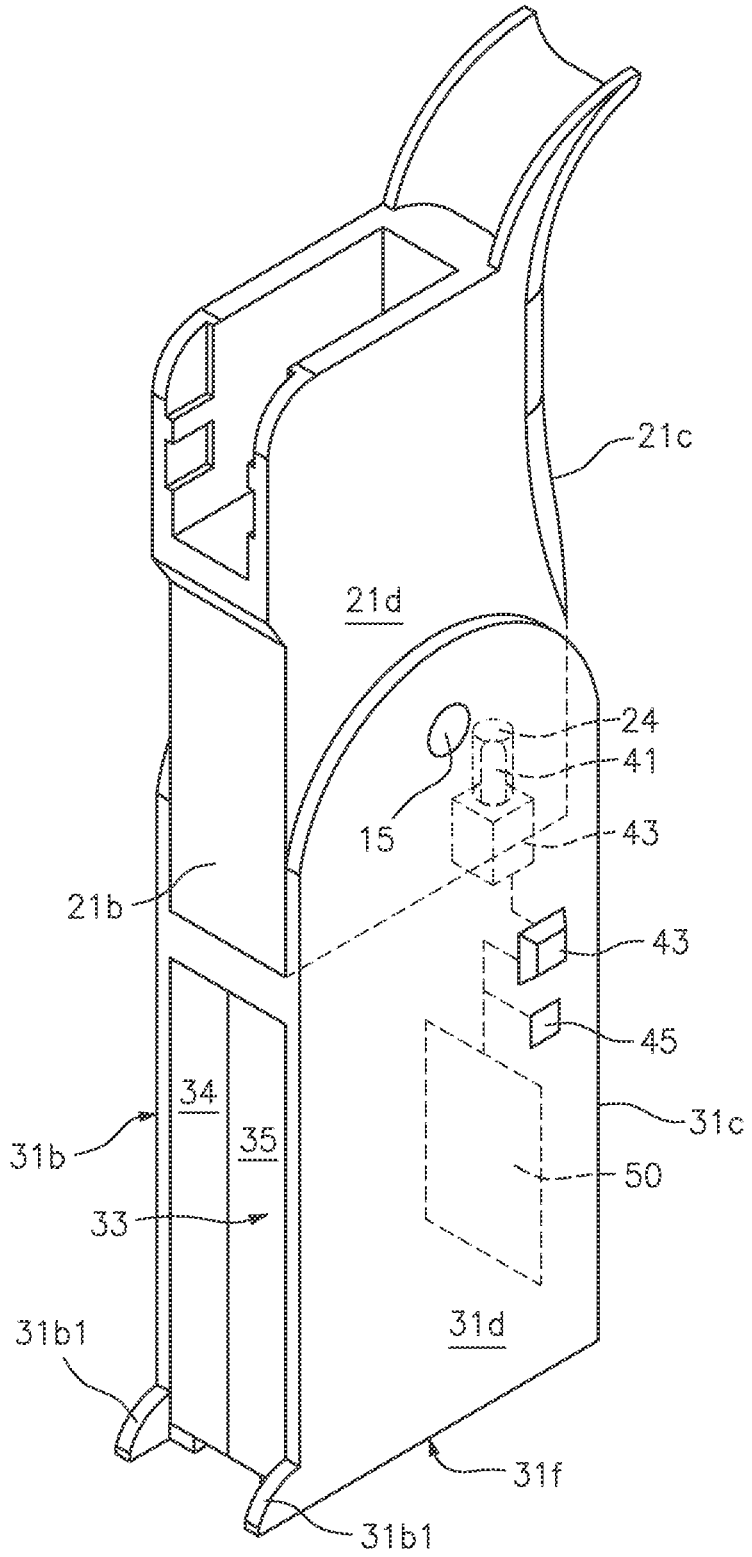
FIG. 4A is a perspective view of the firearm grip with integrated locking mechanism in the FIRE position, in accordance with one embodiment of the invention.

As shown at FIG. 4A, when the handgrip 30 is positioned perpendicular to the locking mechanism 20, the rod 41 can selectively engage the cylindrical channel 24 that is positioned along the bottom back end 21*c* of the locking mechanism. When so positioned, and when the device is secured to a firearm 1, this feature secures the handgrip 30 in the FIRE position.

Figure 4B:
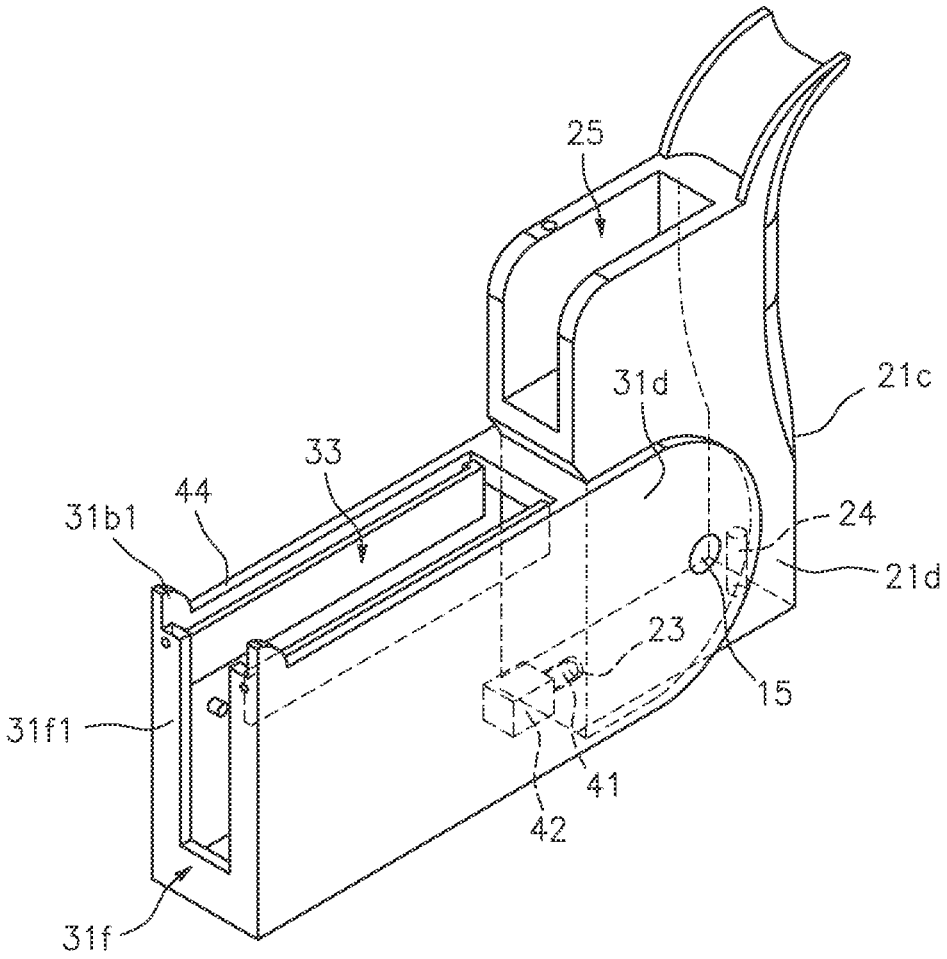
FIG. 4B is a perspective view of the firearm grip with integrated locking mechanism in the SAFE position, in accordance with one embodiment of the invention.

As shown at FIG. 4B, when the handgrip 30 is positioned parallel to the locking mechanism 20, the rod 41 can selectively engage the aperture 23 that is positioned along the front end 21*b* of the locking mechanism. When so positioned, and when the device is secured to a firearm 1, this feature secures the handgrip 30 in the SAFE position with the trigger assembly locked inside the grip body.

Figure 5:
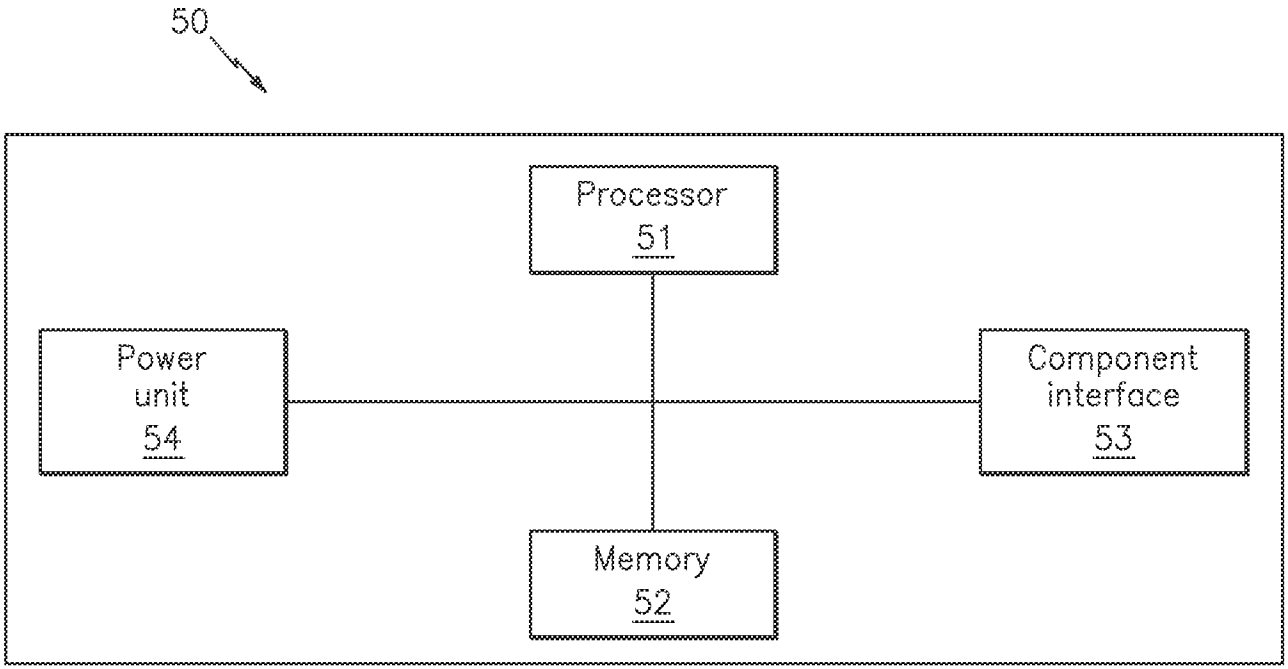
FIG. 5 is a block diagram of the controller of the biometric electro-mechanical locking system, in accordance with one embodiment of the invention.

FIG. 5 illustrates one embodiment of an internal control assembly 50 which can function to control an operation of the authentication unit 45 and the actuator 42. In one embodiment, the internal control assembly can include a processor 51 that is conventionally connected to an internal memory 52, a component interface unit 53, and/or a power source 54.

Although illustrated as separate elements, those of skill in the art will recognize that one or more assembly components may comprise or include one or more printed circuit boards (PCB) containing any number of integrated circuit or circuits for completing the activities described herein. The CPU may be one or more integrated circuits having firmware for causing the circuitry to complete the activities described herein. Of course, any number of other analog and/or digital components capable of performing the below described functionality can be provided in place of, or in conjunction with the below described controller elements.

The processor/CPU 51 can act to execute program code stored in the memory 52 in order to allow the device to perform the functionality described herein. Memory 52 can act to store operating instructions in the form of program code for the processor 51 to execute.

The component interface unit 53 can function to provide a communicative link between the processor 51 and various other device components such as the authentication unit 45 and the actuator 42, for example. In this regard, the component interface unit can include any number of different components such as one or more PIC microcontrollers, internal bus, USB connections and other such hardware capable of providing a direct link between the various components. Of course, any other means for providing the two way communication between the device components can also be utilized herein.

In the preferred embodiment, the power source 54 can include one or more DC batteries capable of providing the necessary power requirements to each element of the device 10. In one embodiment, the batteries can be permanently located within the handgrip body 30 and can be rechargeable in nature via a charging port such as a mini or micro USB port, for example. Of course, traditional batteries can also be utilized and the main body can further include a battery compartment having a removable cover (not illustrated) for allowing a user to access the same.

Figure 6:
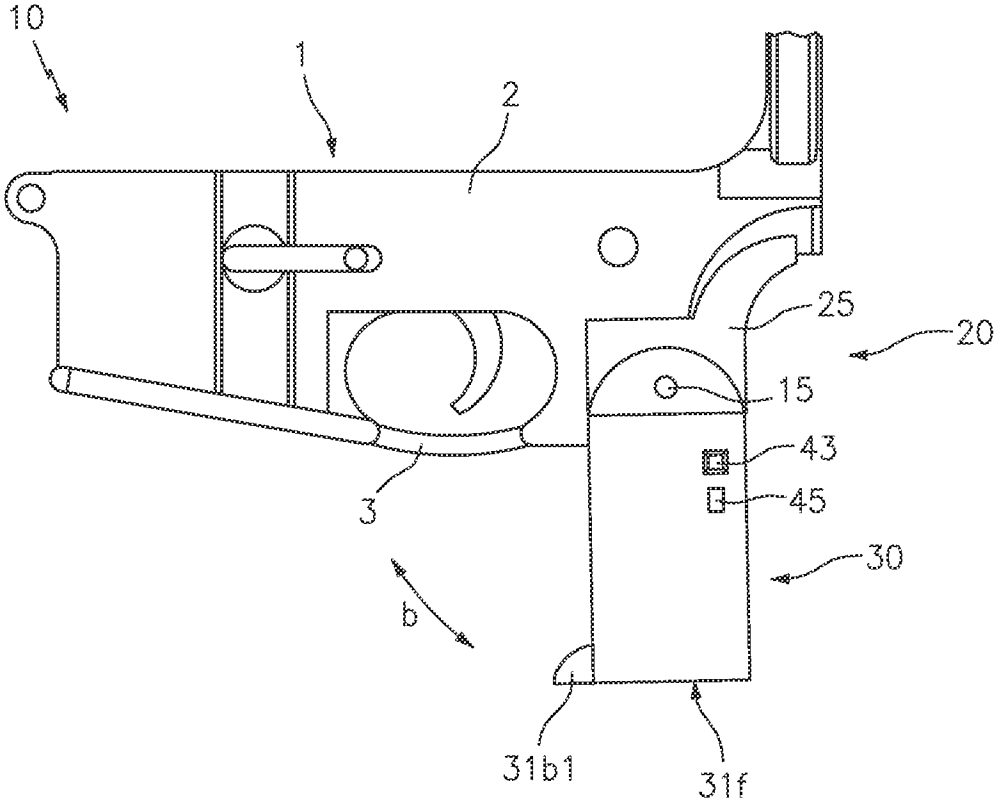
FIG. 6 is a side view of the firearm grip with integrated locking mechanism in operation in the FIRE position, in accordance with one embodiment of the invention.

FIG. 6 illustrates one embodiment of the device 10 in operation with a firearm 1 in the FIRE position. As shown the channel portion 25 is mechanically coupled to the firearm receiver 2 adjacent to the trigger assembly 3. In this position, the handgrip body 30 is oriented perpendicular to the major axis of the weapon, and the doors 34-35 are closed so as to provide a continuous gripping surface for a user to hold and fire the weapon.

At this time, the locking mechanism is engaged with the channel on the bottom end of the engagement member 20 to maintain the device 10 in this position for use. When a user wishes to transition the device to the safe position, the user simply engages the button 43 and/or authentication unit 45, and rotates the front of the handgrip body toward the trigger assembly as shown by arrow b.

Figure 7:
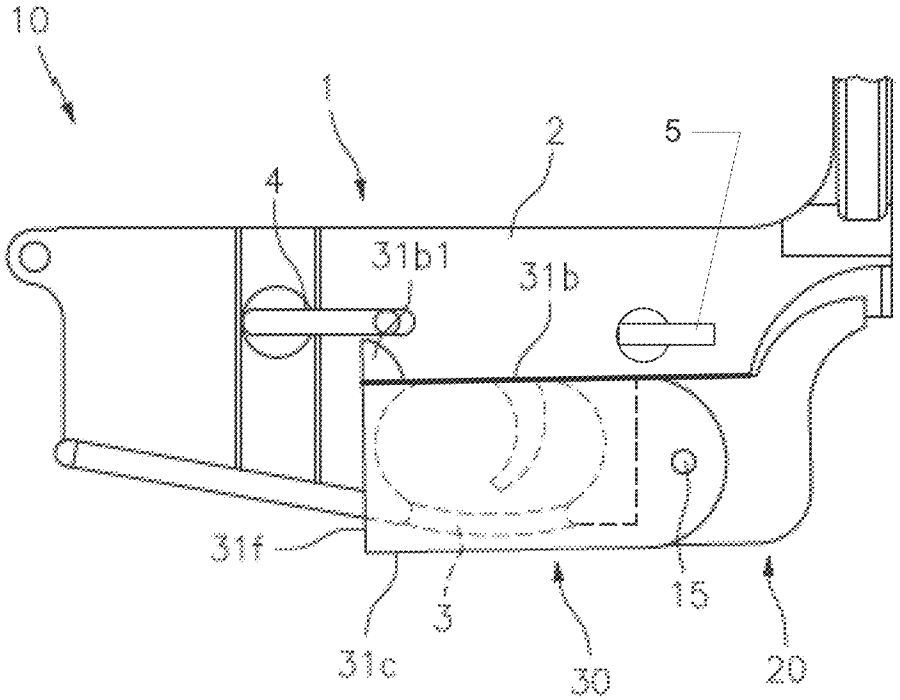
FIG. 7 is a side view of the firearm grip with integrated locking mechanism in operation in the SAFE position, in accordance with one embodiment of the invention.

FIG. 7 illustrates one embodiment of the device 10 in the SAFE position. As shown the channel portion 25 remains mechanically coupled to the firearm receiver 2 adjacent to the trigger assembly 3. As the handgrip body 30 pivots (arrow b) to this position, the bottom end of the trigger assembly engages the doors 34-35 thus overcoming the tensioning mechanisms to move the doors to the open position. With the doors open, the entire trigger assembly, or a majority of the trigger assembly is positioned within the interior space of the handgrip body 30.

At this time, the locking mechanism will engage the aperture on the front of the engagement member 20 to secure the device 10 in the SAFE position where the trigger assembly is inaccessible. Additionally, in this position, the protrusions 31*b*1 are engaged with the magazine selector switch 4 of the receiver, and the side of the body 31*b* is engaged with the fire selector switch 5, thus further locking the weapon in the SAFE position. When an authorized user wishes to transition the device to the FIRE position, the user will preferably be required to use the authentication unit 45 to verify their authorization, before the system will allow the button 43 or actuator to move the rod and allow rotation of the handgrip body to the FIRE position.

Although described above with regard to a particular locking mechanism that engages particular components of the engagement member, this is for illustrative purposes only. To this end, any number of other devices capable of selectively locking the device 10 in either the FIRE or SAFE positions are also contemplated. Additionally, other embodiments are contemplated wherein the orientation of the locking mechanism and the aperture/channel of the engagement unit are positioned differently that described above. For example, the locking mechanism can also be secured along the front of the handgrip body, the sides of the handgrip body and/or multiple different locking mechanisms can be positioned along any portion of the handgrip body with the apertures/channels located at corresponding locations along the firearm engagement unit. To this end, other components such as the button 43, authentication device 45, controller 50 and the like can be positioned anywhere along the device components and are not limited to the locations illustrated.

Figure 8:
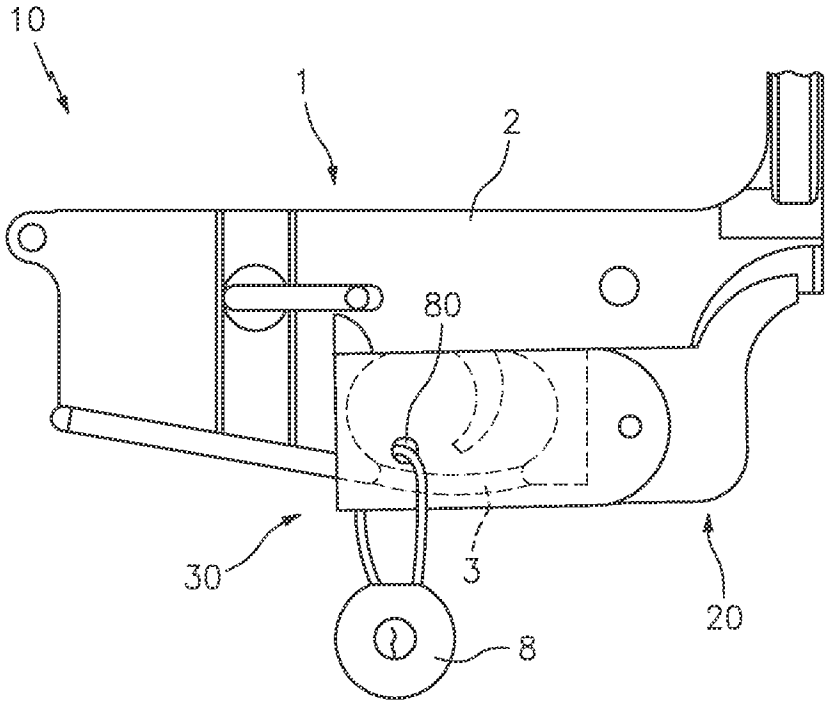
FIG. 8 is another side view of the firearm grip with integrated locking mechanism in operation in the SAFE position, in accordance with one embodiment of the invention.

Additionally, as shown in FIG. 8, the device 10 can also include another pair of large bore apertures 80 which can be positioned through the sides of the receiver body. The aperture 80 being positioned so as to receive an external lock 8 which can extend through the trigger assembly 3 in order to provide double redundancy to prevent access to the weapon. This feature being particularly beneficial for use when traveling or shipping a firearm, or for long term storage, for example.

Accordingly, the above described firearm grip with integrated locking mechanism provides an innovative safety solution that can be permanently mounted onto a firearm in order to secure the same in a locked state.

As described herein, one or more elements of the device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A firearm grip, comprising:

an elongated handgrip body having a top end, a bottom end, a front end, a back end, and a pair of sides forming an interior space;

an elongated opening that is positioned along the front end of the handgrip body;

a pair of doors that are pivotally secured to the handgrip body along the elongated opening, said pair of doors being configured to transition between an open position and a closed position; and a firearm engagement body that is pivotally secured along the top end of the handgrip body, said engagement body including a channel along a top end of the engagement body that is configured to engage a firearm receiver;

wherein the handgrip body is configured to transition between a FIRE position where the handgrip body is positioned perpendicular to the engagement body, and a SAFE position where the handgrip body is positioned parallel to the engagement body.

2. The firearm grip of claim 1, wherein the firearm engagement body includes apertures for receiving hardware to permanently secure the grip to a firearm receiver.

3. The firearm grip of claim 1, further comprising:

a plurality of resilient tensioning members that are in communication with the pair of doors and the receiver body.

4. The firearm grip of claim 3, wherein each of the plurality of resilient tensioning members impart a pushing force onto the doors to maintain the doors in the closed position.

5. The firearm grip of claim 1, further comprising:

a locking mechanism having functionality for securing the handgrip body in at least one of the SAFE position and the FIRE position.

6. The firearm grip of claim 5, wherein the locking mechanism includes an actuator and a rod.

7. The firearm grip of claim 5, further comprising:

a button having functionality to selectively engage the locking mechanism to permit and restrict a movement of the handgrip body.

8. The firearm grip of claim 5, further comprising:

an authentication unit that is in communication with the locking mechanism, said authentication unit including functionality for verifying an identity of an authorized user before allowing operation of the locking mechanism.

9. The firearm grip of claim 8, wherein the authentication unit includes a biometric sensor.

10. The firearm grip of claim 9, further comprising:

a controller having a processor and a memory, said controller being in communication with each of the authentication unit and the locking mechanism.

11. A firearm receiver, comprising:

a receiver body;

a trigger assembly; and a firearm grip that comprises:

an elongated handgrip body having a top end, a bottom end, a front end, a back end, and a pair of sides forming an interior space;

an elongated opening that is positioned along the front end of the handgrip body;

a pair of doors that are pivotally secured to the handgrip body along the elongated opening, said pair of doors being configured to transition between an open position and a closed position; and a firearm engagement body that is pivotally secured along the top end of the handgrip body, said engagement body including a channel along a top end of the engagement body that is in communication with a bottom end of the receiver body adjacent to the trigger assembly;

wherein the handgrip body is configured to transition between a FIRE position where the handgrip body is positioned perpendicular to the receiver body, and a SAFE position where the trigger assembly is positioned between the pair of doors and inside the interior space of the handgrip body.

12. The firearm grip of claim 11, wherein the firearm engagement body is permanently secured to the firearm receiver.

13. The firearm grip of claim 11, further comprising:

a plurality of resilient tensioning members that are in communication with the pair of doors and the receiver body.

14. The firearm grip of claim 13, wherein each of the plurality of resilient tensioning members impart a pushing force onto the doors to maintain the doors in the closed position when the handgrip body is in the FIRE position.

15. The firearm grip of claim 11, further comprising:

a locking mechanism having functionality for securing the handgrip body in at least one of the SAFE position and the FIRE position.

16. The firearm grip of claim 15, wherein the locking mechanism includes an actuator and a rod.

17. The firearm grip of claim 15, further comprising:

a button having functionality to selectively engage the locking mechanism to permit and restrict a movement of the handgrip body.

18. The firearm grip of claim 15, further comprising:

an authentication unit that is in communication with the locking mechanism, said authentication unit including functionality for verifying an identity of an authorized user before allowing operation of the locking mechanism.

19. The firearm grip of claim 18, wherein the authentication unit includes a biometric sensor.

20. The firearm grip of claim 19, further comprising:

a controller having a processor and a memory, said controller being in communication with each of the authentication unit and the locking mechanism.

* * * * *